US005167551A

United States Patent [19]

Davis

[11] Patent Number: 5,167,551

[45] Date of Patent: Dec. 1, 1992

[54] BODYSURFING AND SWIMMING AID

[76] Inventor: Robert G. Davis, 210 Shore Rd., Long Beach, N.Y. 11561

[21] Appl. No.: 763,345

[22] Filed: Sep. 20, 1991

Related U.S. Application Data

[63] Continuation of Ser. No. 459,653, Jan. 2, 1990, abandoned.

[51] Int. Cl.[5] ..... A63B 31/02

[52] U.S. Cl. ..... 441/57

[58] Field of Search ..... 441/55–58, 441/65, 74

[56] References Cited

U.S. PATENT DOCUMENTS 3,117,325 1/1964 Shelton ..... 441/56
3,122,760 3/1964 Glass, Jr. ..... 441/57
4,437,842 3/1984 Connor ..... 441/74
4,629,435 12/1986 Pitcairn ..... 441/74

FOREIGN PATENT DOCUMENTS 2322058 11/1974 Fed. Rep. of Germany ..... 441/58

*Primary Examiner*—Jesûs D. Sotelo
*Attorney, Agent, or Firm*—Kirschstein, Ottinger, Israel & Schiffmiller

[57] ABSTRACT

In the sport of bodysurfing, hand fins are worn and reliably held on the surfer's hands. Each hand fin has longer outer and shorter inner rails for better stability and guidance, a keel for straight tracking through a wave, and curved channels for creating more lift and increased speed through the wave. A peripheral lip provides lift even during steering maneuvers.

14 Claims, 8 Drawing Sheets

BODYSURFING AND SWIMMING AID

This is a continuation of application Ser. No. 07/459,653 filed Jan. 2, 1990, now abandoned.

BACKGROUND OF THE INVENTION

1. Field of the Invention

This invention generally relates to the sports of bodysurfing and swimming and, more particularly, to a pair of hand fins worn by bodysurfers, swimmers and like users in water.

2. Description of Related Art

In recent years, the sport of bodysurfing has increased in popularity. As distinguished from the sport of surfboarding, wherein a surfer typically stands on a board which is propelled through the water by wave action, a bodysurfer adopts a generally prone position in the water, with both arms forwardly outstretched and allows his or her body to be propelled through the water by the action of the waves. Rather than standing on a board, the bodysurfer places his or her hands on a buoyant support and pushes against the same to raise at least his or her head and upper torso out of the water.

The prior art has proposed various buoyant supports to increase buoyancy and otherwise assist the bodysurfer in traveling through the water. For example, U.S. Pat. No. 4,437,842 discloses a single symmetrical buoyant support having a compartment in which one hand of a bodysurfer is inserted, as well as a top wall on which the other hand is placed. In use, a prone bodysurfer raises his or her head and upper torso by pushing downwardly with both hands on the single buoyant support.

However, the known bodysurfing supports have not proven to be altogether satisfactory. For example, the support described in the aforementioned patent is too easily pulled away from the bodysurfer's hands by wave action. The hand lying on the top wall of the support often slides off during use since the top wall is smooth and slippery when wet. Also, water enters the compartment of the support and, despite the presence of recessed portions and ridges to help the bodysurfer obtain a better grip on the support, the water entering the compartment pulls the support away. The force of the entering water and the wave action encountered during bodysurfing are often too great for all but the strongest individuals to withstand in order to prevent pulling away of the buoyant support. Once the support has pulled away, the bodysurfer has no means to support himself or herself for traveling through the water. Also, whenever the bodysurfer needs or wishes to swim, the support described in the aforementioned patent must be abandoned or somehow carried along, thereby hampering the swimming action.

Even when the bodysurfer is successful in holding onto the known buoyant supports, said supports still have not proven to be altogether satisfactory in performance in terms of providing good stability in, and guidance through, the waves. More particularly, the support in the aforementioned patent does not provide adequate steering and/or tracking.

Also, the known supports do not assist the bodysurfer while he or she is swimming out from shore to catch a wave. During swimming, free flexing of the wrist, both up and down, is desirable, but is not readily permitted without mechanical interference with the buoyant support in the known prior art supports.

As a result of the above factors and other considerations, the sport of bodysurfing has been hampered in its growth. Individuals do not like to have their fun ruined by having their sports equipment pulled away each time, or frequently, when they ride a wave. A loose buoyant support also poses a safety hazard, since it can strike and injure the surfer or another. Moreover, the lack of steering and tracking, and the lack of aiding the individual when swimming out to meet the wave, are very undesirable and limit the fun associated with the sport. Finally, it would be desirable to increase the buoyancy of bodysurfing supports, as well as to increase the speed of a surfer through the water.

SUMMARY OF THE INVENTION

1. Objects of the Invention

It is a general object of the present invention to advance the sport of bodysurfing.

It is another object of this invention to securely attach a hand fin to each hand of a bodysurfer, and to affirmatively prevent pulling away of each hand fin during use.

Another object of this invention is to increase the stability of the hand fins during use.

A further object of this invention is to increase the surface area presented by the hand fins with respect to the water, as compared to prior art supports.

Still another object of this invention is to improve the steerability of the hand fins during use.

Yet another object of this invention is to track straight and prevent slipping of the hand fins relative to the water.

A still further object of this invention is to enable a bodysurfer to ride higher on the waves, as compared to prior art supports.

Another object of this invention is to improve the lift and increase the speed of bodysurfing supports.

Still another object of this invention is to reduce the risk of injury due to loose hand fins striking individuals in the water.

A further object of this invention is to facilitate swimming from the shore to the wave.

Yet another object of this invention is to provide a floatation device.

A still further object of this invention is to provide a reliable two-handed, broad-based support to enable a bodysurfer to easily raise his or her head and upper torso out of the water.

2. Features of the Invention

In keeping with these objects, and others which will become apparent hereinafter, one feature of this invention resides, briefly stated, in the use of at least one hand fin in water by bodysurfers, swimmers or like users. The hand fin comprises a generally rigid, buoyant member extending rearwardly from a prow along a longitudinal direction to a stern. The buoyant member has wall means bounding an internal compartment in which a hand of a user is confined during use. A wrist cutout is provided at the stern to permit free wrist flexing of the confined hand relative to the buoyant member during use. The internal compartment has an access opening which constitutes the sole source of access to the internal compartment.

The hand fin also comprises attachable holder means on the buoyant member for securely holding the latter on the confined hand. The holder means includes a tubular holder which extends rearwardly from the access opening. When attached to the hand, the tubular holder circumferentially encloses the wrist of the confined hand and seals the internal compartment from water ingress during use.

Thus, in accordance with one feature of this invention, water is prevented from entering the internal compartment of the buoyant member and, therefore, the hand fin is affirmatively prevented from being pulled away from the user's hand. The risk of injury due to loose hand fins striking a victim is eliminated.

The provision of the wrist cutout enables the user to flex his or her wrist in both an upward and a downward direction relative to the hand fin without mechanical interference therewith. This facilitates swimming to a wave.

As previously mentioned, two hand fins, one for the right hand and the other for the left hand, and mirror-symmetrical relative to each other, are provided for the user. The buoyant member of each hand fin is advantageously provided with a longer outer rail and a shorter inner rail, as considered along the longitudinal direction. The terms "outer" and "inner" are considered with respect to the user; that is, "outer" refers to that portion which faces away from the user, whereas "inner" refers to that portion which faces toward the user. The longer outer rails advantageously put more rail surface into the wave, which enhances the stability and guidance of each hand fin. Moreover, the longer outer rail serves as a brake and pivot upon flexing of one's wrist. The shorter inner rail provides less water resistance to a swimmer since the inner rail, being the one closer to the water, enters the water first during swimming.

The buoyant member of each fin has a bottom surface which faces the water during use. The bottom surface of each fin presents a broad surface area upon which each buoyant member rests on the water. An integral keel advantageously extends away from the bottom surface of each fin into the water. Each keel extends along the longitudinal direction and progressively increases in depth, as considered rearwardly of the fin.

The provision of a keel, preferably in a central region of the bottom surface of each fin, prevents slippage of the fin relative to the water. The bottom surface of each fin is also formed with curved channel portions on opposite sides of a respective keel. Each curved channel portion extends both away from the respective keel, as considered along a transverse direction perpendicular to the longitudinal direction, as well as away from the respective bottom surface along a depth direction which is perpendicular to both the longitudinal and transverse directions. Each keel deflects water along the curved channel portions, and guides each fin to track straight through the wave. In addition, the curved channel portions create more lift, as compared to prior art bodysurfing supports. The increased lift helps keep the prow of each fin up,and allows each fin to ride higher on top of the water.

Still another feature of this invention resides in providing a peripheral lip on the bottom surface of each fin. Each lip extends from the prow along the periphery of each buoyant member toward the stern. Each lip extends from the periphery to the curved channel portions. The lip acts as a wave-bearing surface, and assists in steering the fin toward the right or toward the left. Advantageously, the peripheral lip is rounded to prevent water from grabbing an edge of the fin and flipping over the fin with the surfer. Each lip leads into the curved channel portions and provides a degree of lift during steering maneuvers.

In a preferred embodiment, each buoyant member has a base wall constituted of a rigid, synthetic plastic material. The aforementioned wall means includes a molded mass of synthetic plastic material, preferably an injection-molded foam, secured to the base wall. The internal compartment of each fin includes a plurality of finger chambers, one for each finger of a respectively confined hand. All of the finger chambers of each fin extend to a respective access opening. The tubular holder advantageously is a glove extension which extends rearwardly of finger portions of a glove that are respectively secured in the finger chambers. The extension extends rearwardly of the finger portions past the wrist of the respectively confined hand. An openable/-closeable closure, e.g. a zipper having a pull, is provided on the glove extension.

Each buoyant member also is provided with a palm support portion on which the palm of the respectively confined hand is supported. The palm support portion on each fin is the primary surface upon which the bodysurfer raises his or her head and upper torso.

In use, a bodysurfer enters water having waves, wearing a pair of hand fins, one on each hand, as described above. The zipper advantageously permits the surfer to open or close the glove extension. The closed glove extension circumferentially encloses the wrist of each hand and seals the internal compartment of each fin from water ingress. Since water cannot enter the compartments, each fin is effectively anchored in place and cannot be pulled away by wave action. The only effective way of removing each fin is to open the zipper.

The surfer swims out to meet a wave and, during such swimming, the cutout at the stern of each fin permits free flexing of the surfer's wrists in both the up and down directions. The shorter inner rail of each fin, which enters the water first, offers little water resistance during swimming.

Thereupon, the surfer outstretches his or her arms in a generally parallel relationship, and lies generally prone on the water in the hollow or forming section of a wave. Using the broad bottom surfaces of both hand fins as a support, the surfer can raise at least the head and upper torso out of the water by pushing downwardly with the aid of his or her palms on the palm support portions. The surfer can thus ride the waves while being supported on the hand fins.

During the ride, the longer outer rails put a relatively greater rail surface into the wave for increased stability and guidance. The keel, together with the curved channel portions, deflect water both to the right and the left sides of each fin, thereby allowing each fin to track straight through the wave without side slippage. The curved channel portions create an increased lift, thereby insuring an increased speed through the water, and a prow which is always positioned upwardly of the water. The peripheral lip also assists in steering toward the right or the left, and leads water into the curved channel portions to provide a measure of lift even during steering.

In accordance with the method and arrangement of this invention, the use of the described hand fins enhances the sport of bodysurfing in terms of ease of use, better performance, safety, and greater entertainment value. Each hand fin is constructed of lightweight, durable and buoyant material. The hand fins increase the speed and mobility of the bodysurfer to, and in some cases, beyond, those levels achieved in surfboarding and "baggyboarding". No longer need bodysurfers be either "run over" or forced to yield to the faster surfboarders and baggyboarders.

Quite apart from their use as a bodysurfing aid, the hand fins can also be used as a flotation device, or as an exercising aid for individuals who wish to exercise in the water. The broad bottom surface of each fin displaces more water than, for example, one's hand or a hand paddle, and thus can be used to strengthen one's arm muscles. The flat surfaces of conventional hand paddles tend to position one's hands in uncomfortable, cramped positions and detract from one's ability to obtain leverage in the water while swimming. The hand fins of this invention position one's hands in a more natural, comfortable position and improve hand circulation.

The novel features which are considered as characteristic of the invention are set forth in particular in the appended claims. The invention itself, however, both as to its construction and its method of operation, together with additional objects and advantages thereof, will be best understood from the following description of specific embodiments when read in connection with the accompanying drawings.

DETAILED DESCRIPTION OF THE PREFERRED EMBODIMENTS

Figure 1:
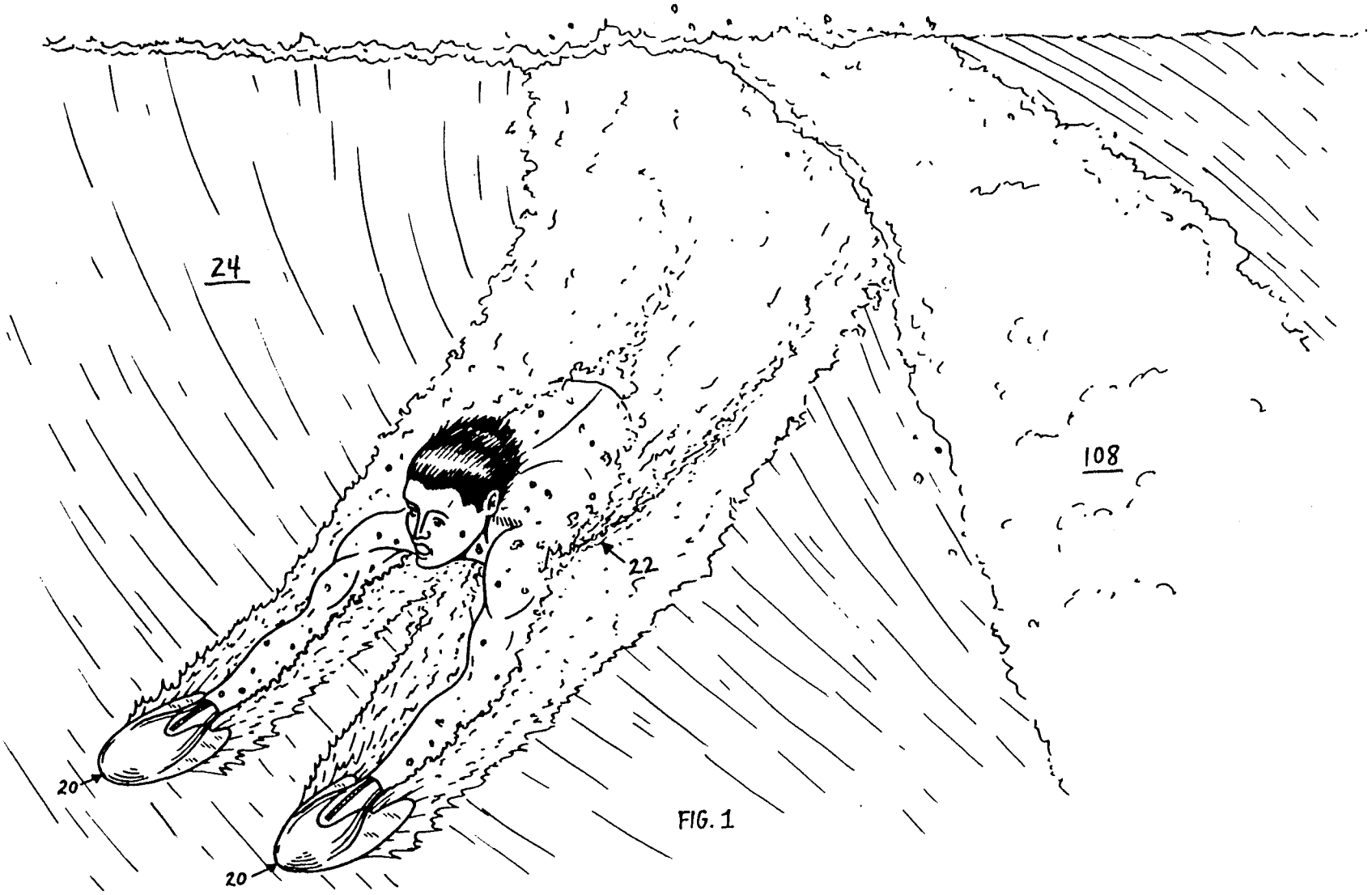
FIG. 1 is a front perspective view of a bodysurfer using a pair of hand fins according to this invention.

Referring now to the drawings, a pair of hand fins 20, 20' are depicted in FIG. 1 during use by a bodysurfer 22 riding a wave 24. The surfer 22 is lying horizontally or generally prone in the water, with both arms forwardly outstretched and spaced apart in a generally parallel or close-together relationship during forward travel along the wave. The head and upper torso of the surfer 22 are raised at least slightly above the water, and are supported in the illustrated position by the surfer's arms which push downwardly against the hand fins.

Hand fins 20, 20' are respectively worn on the surfer's right and left hands. They are mirror symmetrical relative to each other. For ease of description, only the right hand fin 20 is illustrated in the other figures.

Figures 2, 3:
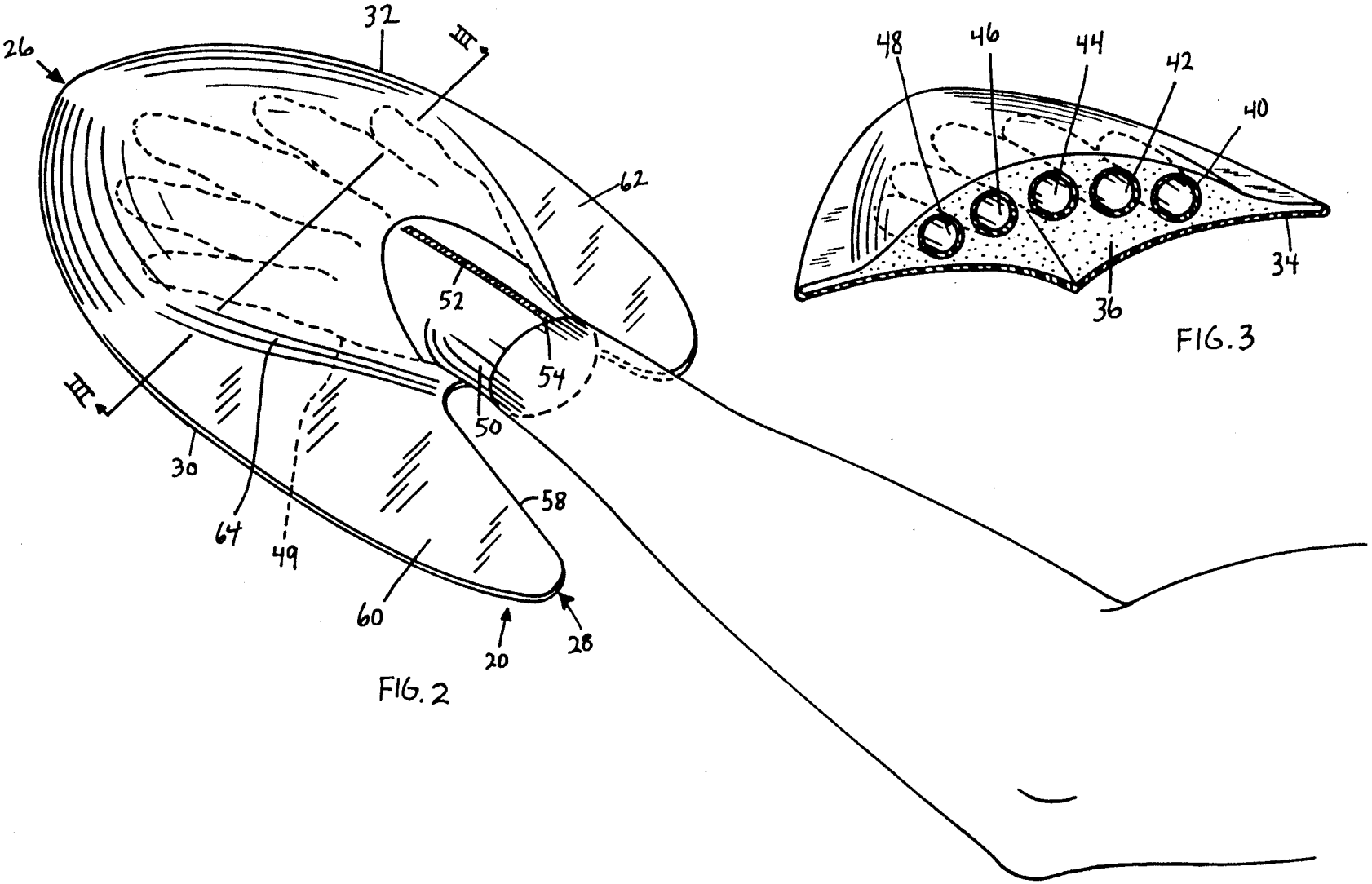
FIG. 2 is a top and rear perspective view of the right hand fin of FIG. 1.
FIG. 3 is a sectional view taken on line III—III of FIG. 2.
Figure 4:
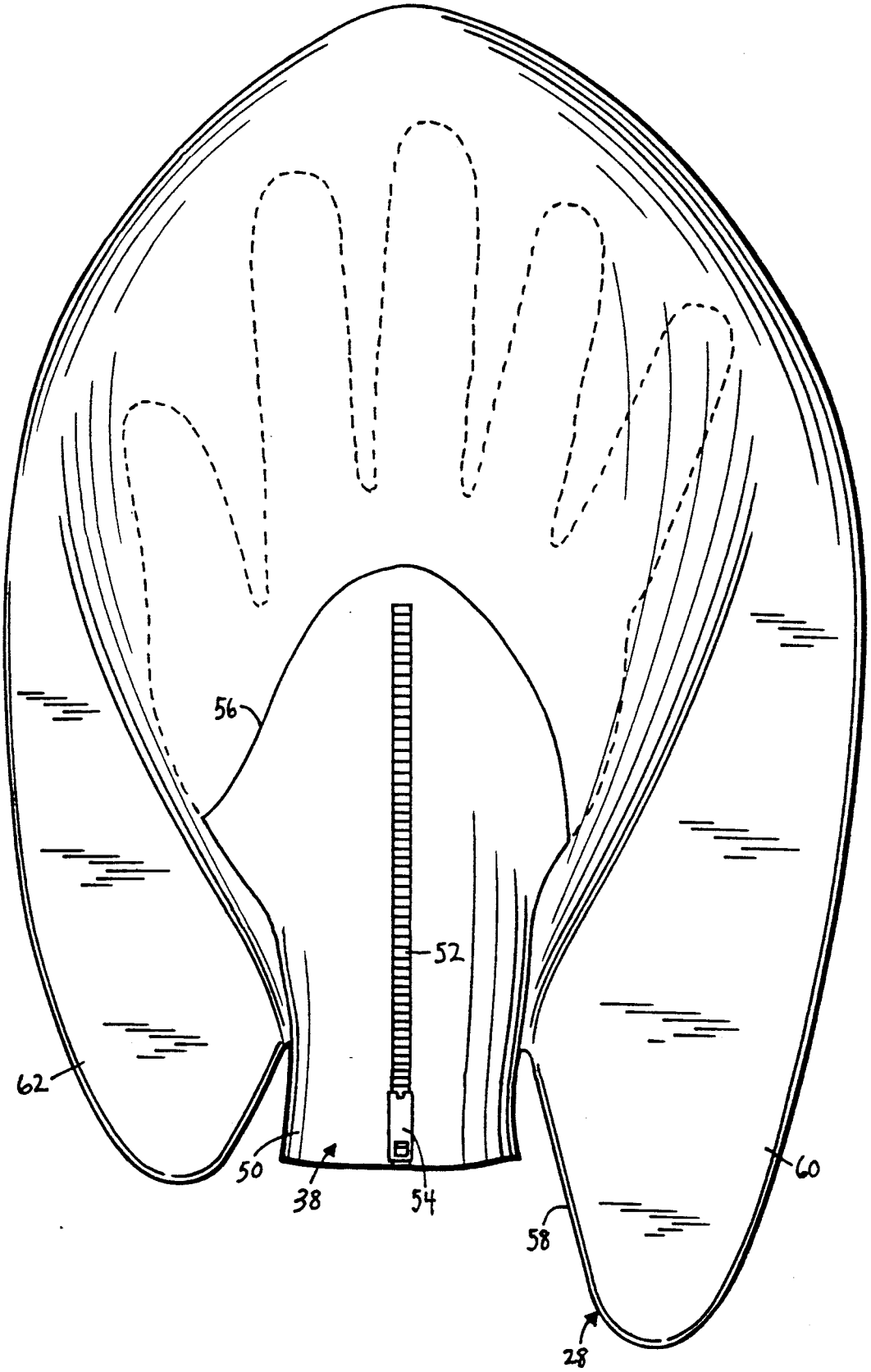
FIG. 4 is an enlarged top plan view of the right hand fin of FIG. 1.
Figure 5:
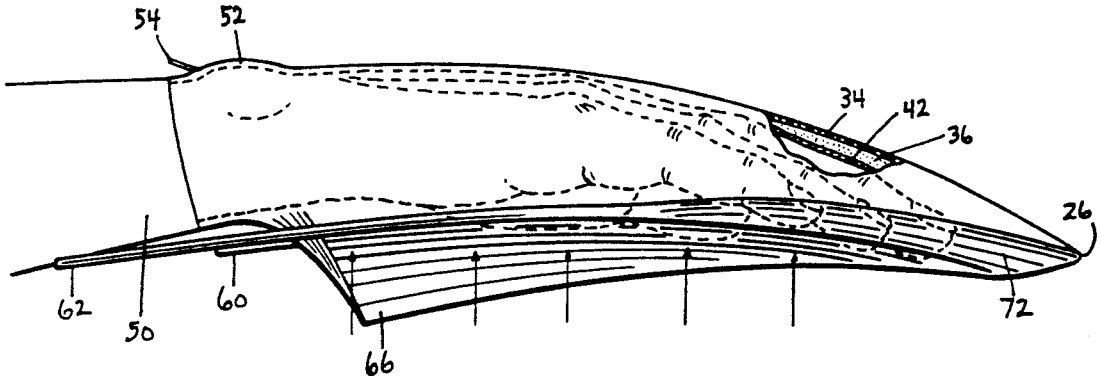
FIG. 5 is a partially broken-away, partially sectioned side view of the right hand fin of FIG. 1.
Figure 6:
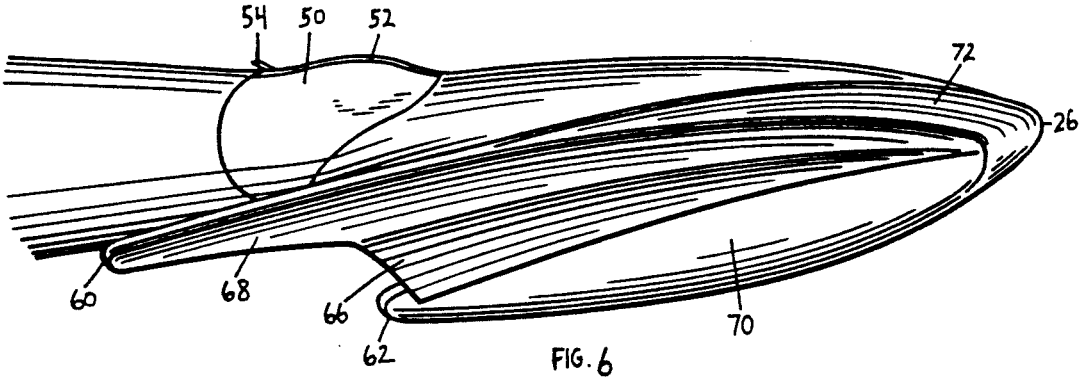
FIG. 6 is a front and bottom perspective view of the right hand fin of FIG. 1.
Figure 7:
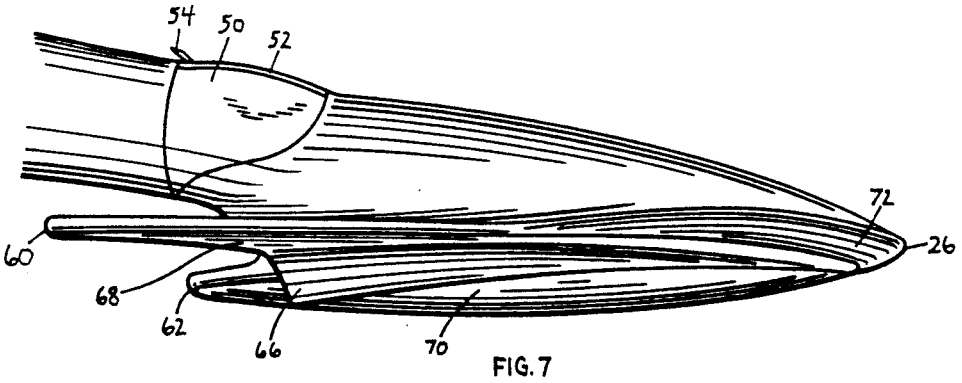
FIG. 7 is a right side view of the fin of FIG. 1.
Figure 8:
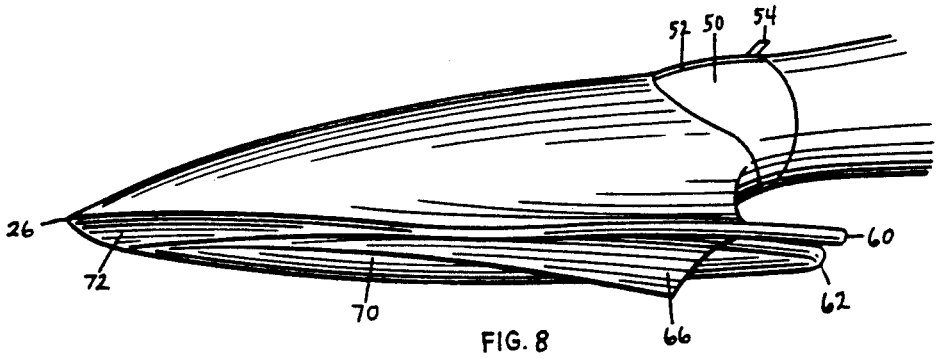
FIG. 8 is a left side view of the fin of FIG. 1.

As shown in FIG. 2, right hand fin 20 includes a leading end, also known as a prow or nose 26, and a trailing end or stern 28 spaced rearwardly along a longitudinal direction from the nose 26. Outer and inner peripheral edge regions 30, 32 extend continuously from the nose to the stern at opposite sides of the fin 20.

As shown in FIG. 3, the fin 20 includes a bottom wall 34, preferably constituted of a rigid material, e.g. a molded plastic. A mass 36 of a synthetic plastic material, e.g. injection-molded foam, is integrally molded in situ on the bottom wall 34. The foam mass 36 is also molded around a glove 38 in order to bound an internal compartment in which the surfer's right hand is closely confined during use in a comfortable, non-cramped position.

The glove 38 may be a mitten having a common pocket for the surfer's fingers, or, according to a preferred embodiment of this invention, the glove 38 has individual finger portions 40, 42, 44, 46, 48, each finger portion being adapted to receive an individual finger of the confined hand. The glove 38 also comprises a hand covering 49 which covers both the palm and the back of the confined hand, as well as a glove extension or tubular holder 50 which extends rearwardly of the hand covering 49 and the finger portions. The glove may be constituted of any flexible material, with neoprene being preferred. A closure, e.g. a zipper 52 and a pull 54, is provided on the holder 50 in order to enable the surfer to open or close the holder 50 to enable the fin 20 to be either selectively worn on or removed from the surfer's hand.

The molding of the foam mass 36 around the glove 38 can occur in several ways. For example, a dummy hand can be inserted and stuffed into the glove and can support the glove in a desired position above the bottom wall 34 during the molding process. Alternatively, a stuffing material can be stuffed into the glove during such molding. In another approach, the glove could be inflated with a pressurized gas to hold its shape during molding. In a custom-made fin, the actual surfer'hand could be inserted into the glove during the molding process. No matter which molding technique is used, once the foam mass has slot, the glove 38 is anchored in place. The individual finger portions and the hand covering, once the dummy hand, stuffing material, pressurized gas or actual hand are removed, bound hollow chambers which readily accept the surfer's fingers and hand. The finger portions and the hand covering have a single common access opening 56. The glove extension 50 extends from this common access opening 56 to and past the surfer's wrist. The surfer's wrist overlies a cutout 58 at the stern to permit the surfer to flex his or her wrist, both up and down, relative to the fin.

The fin 20 has a longer outer rail 60 and a shorter inner rail 62. As previously defined, the terms "outer" and "inner" are defined relative to directions facing respectively away from and toward the surfer. The lengths of the rails are considered along the longitudinal direction. The longer outer rail puts more rail surface into the wave 24, as considered in the direction that the surfer wishes to go, for stability and guidance purposes. If the surfer is going to the right, then the longer outer rail of the right fin grabs the wave. The longer outer rail also acts as a brake or pivot surface when the surfer's wrist is tilted. The surfer brakes to either slow down to enter the better part of the wave, or stops to avoid getting hit, or hitting someone or something else. The shorter inner rail 62, which enters the water first, offers less resistance during swimming, as compared to the outer rail, and less chance of self-injury to the stomach or chest during swimming. The outer and inner rails generally lie in a common plane on opposite sides of a central humped portion 64 which is constituted of the foam mass that bounds the internal compartment in which the surfer's hand is confined.

Figure 9:
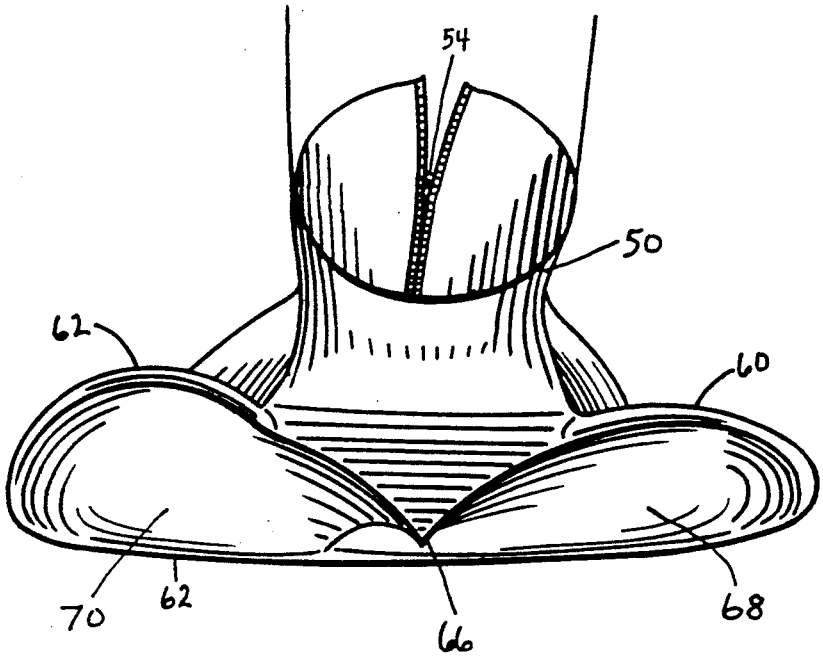
FIG. 9 is a rear view of the fin of FIG. 1.

Turning now to FIGS. 6–9, a keel 66 integral with the bottom wall 34 extends downwardly thereof in a central region of the fin. As shown in FIG. 9, the keel 26 has a generally triangular cross-section, and has hollowed-out curved side walls. The keel 66 extends longitudinally from a point just rearwardly of the nose 6 to the stern. The depth of the keel progressively and continuously increases along the longitudinal direction, and reaches its maximum depth dimension at the stern.

On either side of the keel 66, the bottom wall 34 is also formed with curved channel portions 68, 70 which continuously merge into the curved side walls of the keel. Each channel portion 68, 70 is curved upwardly in a direction away from the water, and is also curved outwardly in a direction away from the keel. In addition, a peripheral lip 72 of rounded contour extends from the nose 26 along each peripheral edge 30, 32 to the stern. The lip 72 has a generally planar underside which faces the water.

Figure 11:
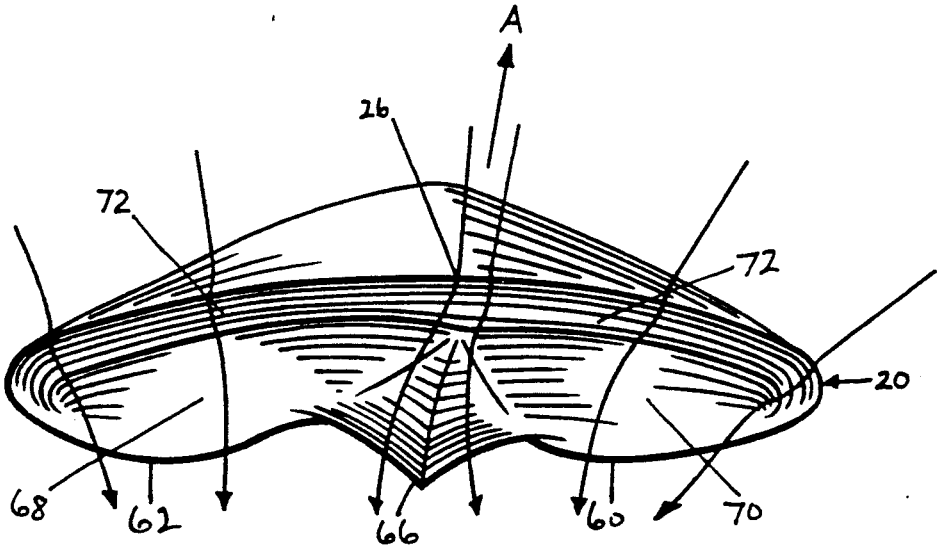
FIG. 11 is a front view of the fin of FIG. 10 with water flow lines superimposed thereon.
Figure 10:
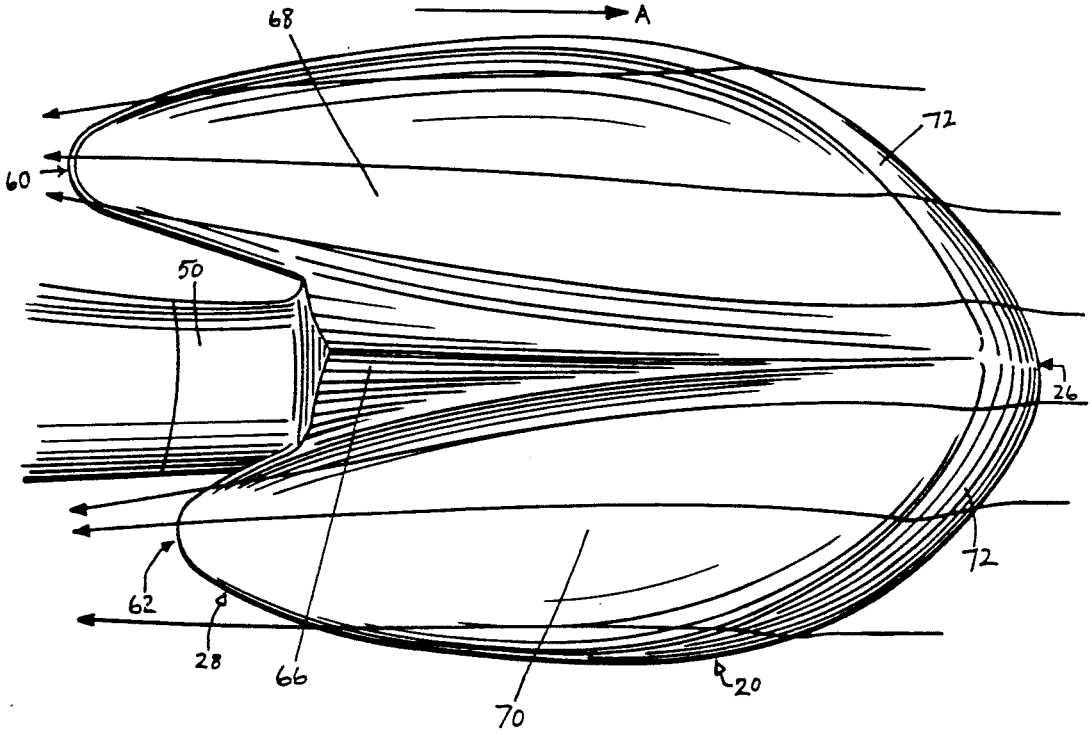
FIG. 10 is a bottom plan view of the fin of FIG. 1 with water flow lines superimposed thereon.
Figure 12:
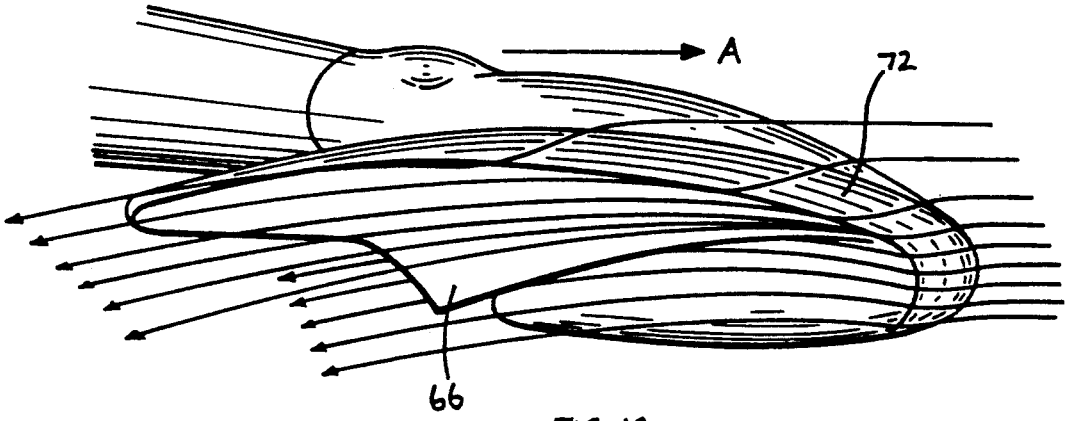
FIG. 12 is a front and bottom perspective view of the fin of FIG. 10 with water flow lines superimposed thereon.

Turning now to FIGS. 10–12, the forward direction of the fin 20 in the water is denoted by the arrow labeled A. Water flow lines are superimposed on the fin 20 to show how the water is routed along the fin in use. It will be observed that on-coming water first bears against the lip 72 which leads the water into the curved channel portions 68, 70. The lip 72 provides a measure of lift to the fin, even when steering. The undersurface of the lip 72 bears against the water, and is used during steering to enable the surfer to go right or left. The rounded contour of the lip 72 prevents a wave from grabbing the edge of the fin to capsize the same with the surfer.

The water led into the curved channel portions 68, 70 flows along their upper curvature in order to create lift to enable the fin to ride high on the water, as well as to raise the nose 26 above the water. The water is also forced downward as it leaves the hand fins. This minimizes spray into the surfer's face. The keel 66 channels the water in the curved channel portions 68, 70 on opposite sides of the keel toward the right and toward the left underneath the rails 60, 62. The keel helps the fin to track straight through the water, and prevents slippage of the fin relative to the wave. Stability and guidance are achieved primarily by the longer outer rail 60. The bigger the wave, the higher the surfer can lift his or her body out of the water. A larger wave causes higher speeds and, in turn, greater stability and performance.

During use, water ingress into the internal compartments which confine the surfer's hands is reliably prevented by the tubular holders 50 which circumferentially enclose both wrists and seal both internal compartments from water which would otherwise tend to pull the hand fins away from the surfer.

Each hand fin has a streamlined shape, with a pointed prow and smooth contours to enable each fin to smoothly move through and over the water. The synthetic plastic material composition of each fin, and particularly that introduced by the foam mass, enables each fin to be buoyant and to serve as a lightweight flotation device.

When, or if, the hand fins are submerged during bodysurfing or swimming, the hand fins will, when held forwardly outstretched, tend to lift the bodysurfer/swimmer toward the surface of the water. The underside and the lip of each fin is so shaped to have a greater lifting pressure at the underside of the fin than the downward water pressure exerted at the top side of the fin. This safety feature enables the bodysurfer to avoid the violent churning water just below the water surface. The churning water is caused by the passing of the wave after it has broken and formed "white water", as depicted at 108 in FIG. 1.

The surfer's hands need not be strictly mutually parallel, but should be close together forwardly of the generally prone body. The surfer tries to keep his or her body in a horizontal plane. As shown in FIG. 1, wherein a surfer is shown entering the wave 24, the horizontal surfer rides the ever-new forming section of the wave, ahead of the white-water section 108.

The stern cutout is advantageously used during swimming from shore to an on-coming wave by enabling the surfer's wrist to flex freely in both the up and down directions. Quite apart from its use by bodysurfers, swimmers who wish to develop the musculature of their arms may swim using the hand fins of this invention. The broad lower surfaces of the hand fins offer greater water resistance than that encountered by one's hands alone.

It will be understood that each of the elements described above, or two or more together, also may find a useful application in other types of constructions differing from the types described above.

While the invention has been illustrated and described as embodied in a bodysurfing and swimming aid, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended claims.

I claim:

1. A hand fin for use in water by bodysurfers, swimmers and users participating in watersports, comprising:

a generally rigid, buoyant member extending rearwardly from a prow along a longitudinal direction to a stern, and having wall means bounding an internal compartment in which a hand of a user is closely confined during use, said wall means including molded portions encircling the fingers of the confined hand and a humped support portion on which the confined hand is buoyantly supported during use, and a pair of rail portions spaced apart of each other along a transverse direction generally perpendicular to the longitudinal direction, said rail portions extending along the longitudinal direction past a wrist of the confined hand and bounding a wrist cutout at the stern to permit free wrist flexing of the confined hand relative to the buoyant member between the rail portions during use, said internal compartment having an access opening which constitutes the sole source of access to the internal compartment; and attachable holder means on the buoyant member, for securely holding the buoyant member on the confined hand, and including a tubular holder extending rearwardly from the access opening and, when attached, circumferentially enclosing the wrist of the confined hand and sealing the internal compartment from water ingress during use, said rail portions extending rearwardly past the tubular holder at opposite lateral sides thereof.

2. The hand fin according to claim 1; and further comprising another hand fin attachable on the other hand of the user, said hand fins being mirror symmetrical.

3. The hand fin according to claim 1, wherein the buoyant member has a base wall constituted of a rigid, synthetic plastic material; and wherein the wall means includes a molded mass of synthetic plastic material secured to the base wall.

4. The hand fin according to claim 1, wherein the buoyant member has a streamlined shape to resist water drag and is constituted of a lightweight material.

5. The hand fin according to claim 1, wherein one of the rail portions is longer, as considered along the longitudinal direction, than the other of the rail portions.

6. A bodysurfing arrangement for use in water by bodysurfers, comprising:

a pair of hand fins, one worn on each hand of a bodysurfer, each hand fin including a generally rigid, buoyant member extending rearwardly from a prow along a longitudinal direction to a stern, and having wall means bounding an internal compartment in which a respective hand is closely confined during bodysurfing, each wall means including molded portions encircling the fingers of the respective confined hand and a humped support portion on which the respectively confined hand is buoyantly supported to raise at least the head and upper torso of the bodysurfer out of the water during bodysurfing, each wall means having rail portions bounding a wrist cutout at the stern to permit free wrist flexing of the respectively confined hand relative to the buoyant member during bodysurfing, said internal compartment having an access opening which constitutes the sole source of access to the internal compartment; and attachable holder means on the buoyant member, for securely holding the buoyant member on the respectively confined hand, and including a tubular holder extending rearwardly from the access opening and, when attached, circumferentially enclosing the wrist of the respectively confined hand and sealing the internal compartment from water ingress during bodysurfing, said rail portions extending rearwardly past the tubular holder at opposite lateral sides thereof.

7. A hand fin for use in water by bodysurfers, swimmers and users participating in watersports, comprising:

a generally rigid, buoyant member extending rearwardly from a prow along a longitudinal direction to a stern, and having wall means bounding an internal compartment in which a hand of a user is confined during use, and also bounding a wrist cutout at the stern to permit free wrist flexing of the confined hand relative to the buoyant member during use, said internal compartment having an access opening which constitutes the sole source of access to the internal compartment, said buoyant member having a bottom surface which faces the water during use, and an integral keel extending away from the bottom surface into the water along a depth direction that is generally perpendicular to the longitudinal direction and to a transverse direction that is generally perpendicular to the longitudinal direction; and attachable holder means on the buoyant member, for securely holding the buoyant member on the confined hand, and including a tubular holder extending rearwardly from the access opening and, when attached, circumferentially enclosing the wrist of the confined hand and sealing the internal compartment from water ingress during use.

8. The hand fin according to claim 7, wherein the keel progressively increases in depth along the longitudinal direction.

9. The hand fin according to claim 7, wherein the bottom surface has curved channel portions on opposite sides of the keel, and extending both away from the keel along the transverse direction, and away from the bottom surface along the depth direction, and wherein the keel deflects water along the curved channel portions along both the transverse and depth directions.

10. The hand fin according to claim 9, wherein the bottom surface has a peripheral lip extending from the prow along the periphery of the buoyant member toward the stern, the lip extending from the periphery to the curved channel portions.

11. The hand fin according to claim 10, wherein the peripheral lip has a rounded contour.

12. A hand fin for use in water by bodysurfers, swimmers and users participating in watersports, comprising:

a generally rigid, buoyant member extending rearwardly from a prow along a longitudinal direction to a stern, and having wall means bounding an internal compartment in which a hand of a user is confined during use, and also bounding a wrist cutout at the stern to permit free wrist flexing of the confined hand relative to the buoyant member during use, said internal compartment having an access opening which constitutes the sole source of access to the internal compartment, said internal compartment having a plurality of finger chambers, one for each finger of the confined hand, all of the finger chambers extending to the access opening; and attachable holder means on the buoyant member, for securely holding the buoyant member on the confined hand, and including a tubular holder extending rearwardly from the access opening and, when attached, circumferentially enclosing the wrist of the confined hand and sealing the internal compartment from water ingress during use.

13. The hand fin according to claim 12, wherein the holder means includes a glove having finger portions respectively secured in the finger chambers, and wherein the tubular holder is a glove extension extending rearwardly of the finger portions past the wrist of the confined hand; and wherein the holder means includes a closure on the glove extension.

14. The hand fin according to claim 13, wherein the closure is a zipper.

* * * * *